US005569873A

United States Patent [19]

Walters et al.

[11] Patent Number: 5,569,873

[45] Date of Patent: Oct. 29, 1996

[54] METHOD FOR DISPERSING A JET FROM A SHAPED CHARGE LINER VIA SPIN COMPENSATED LINERS

[75] Inventors: William Walters, Elkton; Richard Summers, Conowingo, both of Md.

[73] Assignee: The United States of America as represented by the Secretary of the Army, Washington, D.C.

[21] Appl. No.: 543,973

[22] Filed: Oct. 17, 1995

[51] Int. Cl.[6] ..... F42B 12/10

[52] U.S. Cl. ..... 102/476; 102/307

[58] Field of Search ..... 102/306–310, 102/476

[56] References Cited

U.S. PATENT DOCUMENTS

| | | | |
|---|---|---|---|
| H33 | 3/1986 | Jameson et al. | 102/476 |
| 3,146,711 | 9/1964 | Schaadt et al. | 102/476 |
| 3,217,650 | 11/1965 | Paul et al. | 102/476 |
| 3,218,975 | 11/1965 | Massey | 102/476 |
| 3,726,224 | 4/1973 | Pugh et al. | 102/476 |
| 3,732,818 | 5/1983 | Thomanek | 102/306 |
| 4,421,030 | 12/1983 | Dekoker | 102/476 |
| 4,494,459 | 1/1985 | Zumba | 102/476 |
| 4,598,884 | 7/1986 | Speer | 102/476 |
| 5,279,228 | 1/1994 | Ayer | 102/306 |

*Primary Examiner*—Harold J. Tudor
*Attorney, Agent, or Firm*—Freda L. Krosnick; Paul S. Clohan; Charles H. Harris

[57] ABSTRACT

A method is provided for dispersing and/or disrupting an aligned jet from a shaped charge round. A fluted shaped charge liner, typically used to compensate for spin effects on a coherent jet in a spin stabilized round is applied to a non-spinning round to produce a dispersed and/or disrupted jet pattern. The effect of disruption may also be altered by altering the subcalibration ratio (ratio of liner diameter to charge diameter). For a given liner diameter, an increase in charge diameter may result in increased dispersion of the jet. In addition, other types of spin compensated liners such as those using so-called metallurgical spin compensation, may be applied to a non-spinning round to produce dispersion and/or disruption of the jet. Moreover, the rate of spinning of the round (or the direction of spin) may be altered such that the spin compensated liner produces a dispersed jet pattern.

6 Claims, 3 Drawing Sheets

METHOD FOR DISPERSING A JET FROM A SHAPED CHARGE LINER VIA SPIN COMPENSATED LINERS

STATEMENT OF GOVERNMENT INTEREST

The subject matter of the present application was developed by employees of the U.S. Government, Department of the Army, Army Research Laboratory, in the course of their employment. The U.S. Government has a paid-up license in this invention and the right to require the patent owner to license others on reasonable terms.

CROSS-REFERENCE TO RELATED APPLICATIONS

The subject matter of this application is related to that disclosed in copending applications Ser. Nos. 08/543,972 filed Oct. 17, 1995, and 08/544,082 filed Oct. 17, 1995.

FIELD OF THE INVENTION

The present invention relates to a method and apparatus for dispersing a jet from a shaped charge liner in an ammunition round to provide a wider impact area against large targets.

BACKGROUND OF THE INVENTION

Shaped charge designs in present use (i.e., in weapon systems, oil well completion, or drilling operations) may be designed to provide a deep hole in a target material and maximize crater volume. Such shaped charge configurations achieve maximum penetration by projecting a continuous rod or a stream of particles, in near perfect alignment, against a target material. Since penetration is directly proportional to the length of the penetrator, care is taken to maximize the jet length and to keep jet particles well aligned. This concept results in deep holes, of relatively small diameter, in a target.

However, certain applications may require attack of relatively thin targets (i.e., materials of low strength and small thicknesses). Conventional shaped charges do relatively little damage against such targets. For example, a shaped charge fired against a lightly armored vehicle will do minimal ballistic damage. The jet will perforate such a vehicle leaving only a small entrance and exit hole. Against targets of this type, it may be advantageous to reduce the effective depth of penetration and spread the impacting penetrator jet over a wider surface area to maximize the total damage to the target. This type of damage may be obtained by dispersing the jet in a radial fashion to increase the surface area impacted by the jet.

In addition, it may be desirable to provide a particular jet pattern for particular types of targets. For example, when using a shaped charge to destroy a missile or the like, a particular pattern may be desirable to insure that at least a portion of the penetrator jet impacts the missile.

Moreover, it may be desirable to provide a shaped charge round which may be selectively provided with either aligned or dispersed shaped charges to provide either aligned or dipersed jet patterns, respectively when detonated. The use of a single round type to provide both types of charges may reduce inventory costs significantly and allow for selection, in the field, of charge type for a given round. In addition, the use of a same or similar charge type for both aligned and dispersed shape charge types may reduce manufacturing costs of such charges due to the economies of scale in manufacturing a common charge design.

FIG. 1 is a side view of a prior art shaped charge round. Explosive fill 10 within casing 24 surrounds a hollow cavity made by liner 15. Liner 15 is illustrated in FIG. 1 as a conical insert with a thin wall although any arcuate geometry may be used depending on desired result. Casing 24 may be a regular cylinder or may take other forms (e.g., tapered or boat-tailed cylinder). The shaped charge round of FIG. 1 may be typically point initiated by a booster/detonator absently 18 located along an axis of revolution of the round.

The shaped charge round of FIG. 1 may be incorporated into an artillery shell, mortar shell, missile (e.g., surface to air missile, wire guided missile, air to air missile, or the like) or may be incorporated into charges used for industrial purposes (e.g., oil exploration, mining, explosive welding, or the like).

Once the round of FIG. 1 has been detonated, liner 15 collapses to form a high speed jet. The use of liner 15 is described, for example, in H. Mohaupt, U.S. Pat. No. 2,419,414, issued Apr. 22, 1947, incorporated herein by reference.

SUMMARY AND OBJECTS OF THE INVENTION

A method is provided for disrupting or dispersing a jet from a shaped charge liner to increase damage area to a target. A shaped charge round is provided having a spin compensated shaped charge liner for providing a coherent jet upon detonation of the shaped charge round at a first predetermined spin rate and direction. The shaped charge round is then fired at a second predetermined spin rate different from the predetermined spin rate to provide a dispersed jet of a predetermined pattern upon detonation of the shaped charge round. The spin compensated shaped charge liner may comprise a fluted shaped charge liner or a metallurgically spin compensated shaped charge liner.

The shaped charge round may be fired at a zero spin rate, a spin rate greater than the first predetermined spin rate, or at a spin rate less than the first predetermined spin rate. In addition, the shaped charge round may be fired in a spin direction opposite than the first predetermined spin direction.

The shaped charge round may also comprise a charge portion surrounding the spin compensated shaped charge liner, where the diameter of the charge portion exceeds the diameter of the spin compensated shaped charge liner.

A shaped charge round provides a dispersed jet upon detonation of the shaped charge round. The shaped charge round includes a substantially cylindrical outer casing for containing the shaped charge round. The substantially cylindrical outer casing is open at one end. An explosive charge is provided within the outer casing. A shaped charge liner having a substantially conical shape is provided within the substantially cylindrical outer casing and in contact with the explosive charge. The diameter of the substantially cylindrical outer casing is greater than the diameter of the shaped charge liner so as to increase the subcalibration ratio of the shaped charge round over that of a standard shaped charge round having a substantially cylindrical outer casing with a diameter equal to a diameter of a shaped charge liner to provide a substantially dispersed jet upon detonation of the shaped charge round.

It is an object, therefore, of the present invention, to disperse the jet of a shaped charge round into a dispersed jet.

It is a further object of the present invention to disperse the jet of a shaped charge round into a dispersed jet of a predetermined pattern.

It is a further object of the present invention to provide an inexpensive and readily implemented apparatus for dispersing the jet of a shaped charge round.

It is a further object of the present invention to provide a round design having common elements for both shaped charge and dispersed jet applications.

Still other objects and advantages of the present invention will become readily apparent to those skilled in this art from the following detailed description, wherein only the preferred embodiment of the invention is shown and described, simply by way of illustration of the best mode contemplated of carrying out the invention. As will be realized the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTIONS OF THE DRAWINGS

DETAILED DESCRIPTION OF THE INVENTION

The apparatus and method of the present invention may be utilized to radially disperse a jet from a shaped charge round. Radial dispersion is intended to convert a coherent jet penetrator into a series of fragmenting particles or produce a "shotgun" like effect against the target. In particular, the method of the present invention disrupts or disperses a jet from a shaped charge liner using a conventional, but non-spinning, fluted liner.

Figure 1:
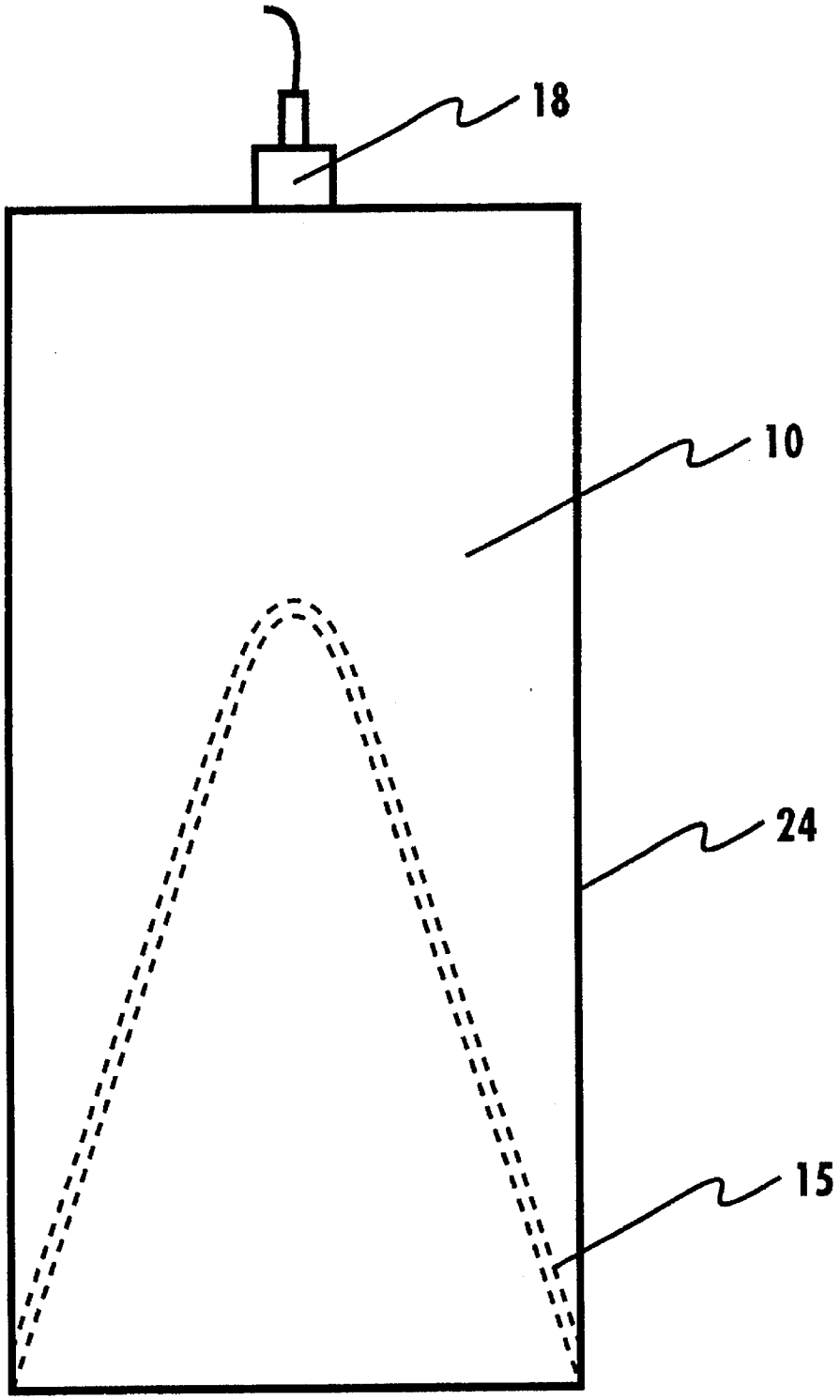
Fig. 1 (PRIOR ART)
FIG. 1 is a side view of a prior art shaped charge illustrating the charge liner in dashed lines.
Figure 2A:
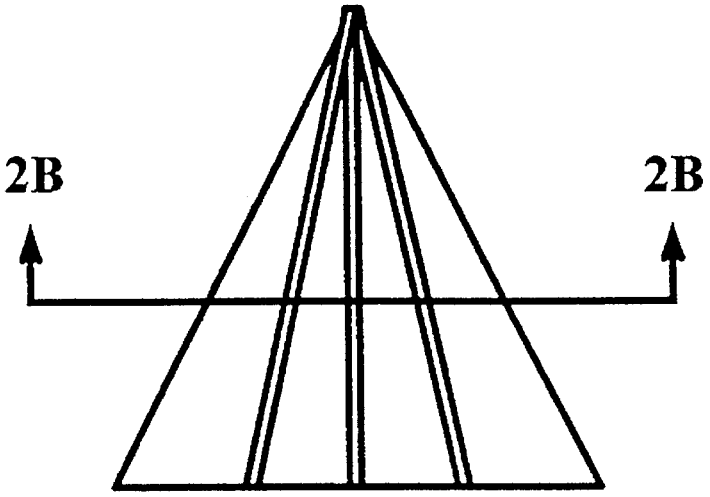
FIG. 2A is a side view of a fluted charge liner of the present invention.
Figure 2B:
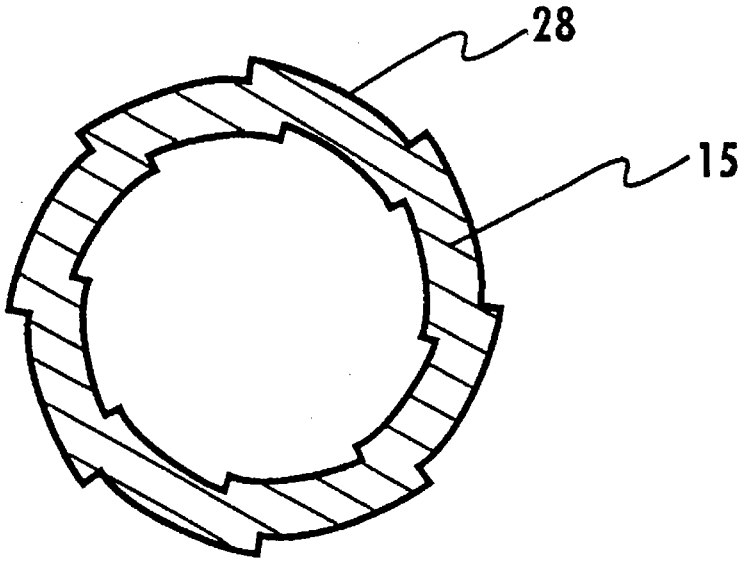
FIG. 2B is a cross-section view of the fluted charge liner of FIG. 2A along line 2B—2B'.

A fluted charge liner, known in the prior art, and illustrated in FIG. 2A, comprises a charge liner with raised ridges on the liner designed to impart angular momentum to the jet to compensate for spin imparted to a jet formed from a warhead which is spinning in flight. FIG. 2B illustrates a cross-section of fluted liner 15 containing flutes 28. The direction of flutes 28 may be opposite to the direction of spin of the warhead (e.g., opposite the direction of spin imparted by rifling or spin stabilization of a warhead). Thus, when a jet is formed, a counter-spin is imparted to the jet by flutes 28, with the net effect being a coherent jet. If flutes 28 were not provided in a spinning warhead, the resulting jet may be dispersed in a spiral radial fashion.

If the fluted liner shaped charge is fired when the warhead is not spinning, the angular momentum imparted to the jet from the flutes will cause a radial dispersion. This dispersion of the jet causes the jet to fragment into a series of particles in a radial or "shotgun" like pattern. This observation is applied to targets which are susceptible to attack by dispersed jets. It is observed that the amount of dispersion increases from tip to tail.

The dispersion pattern ranges from a damage area of 220 millimeters in diameter at a relatively short standoff up to a damage area of 1830 millimeters in diameter at a 10 meter standoff as tested in Experimental Range Facility No. 16, in Round Nos. 3868, 4594, and 4595 targeting steel armor plate. If a similar round is fired in its normal (spinning) mode the entrance hole diameter or damage area may be on the order of 40 millimeters in diameter.

Figure 3:
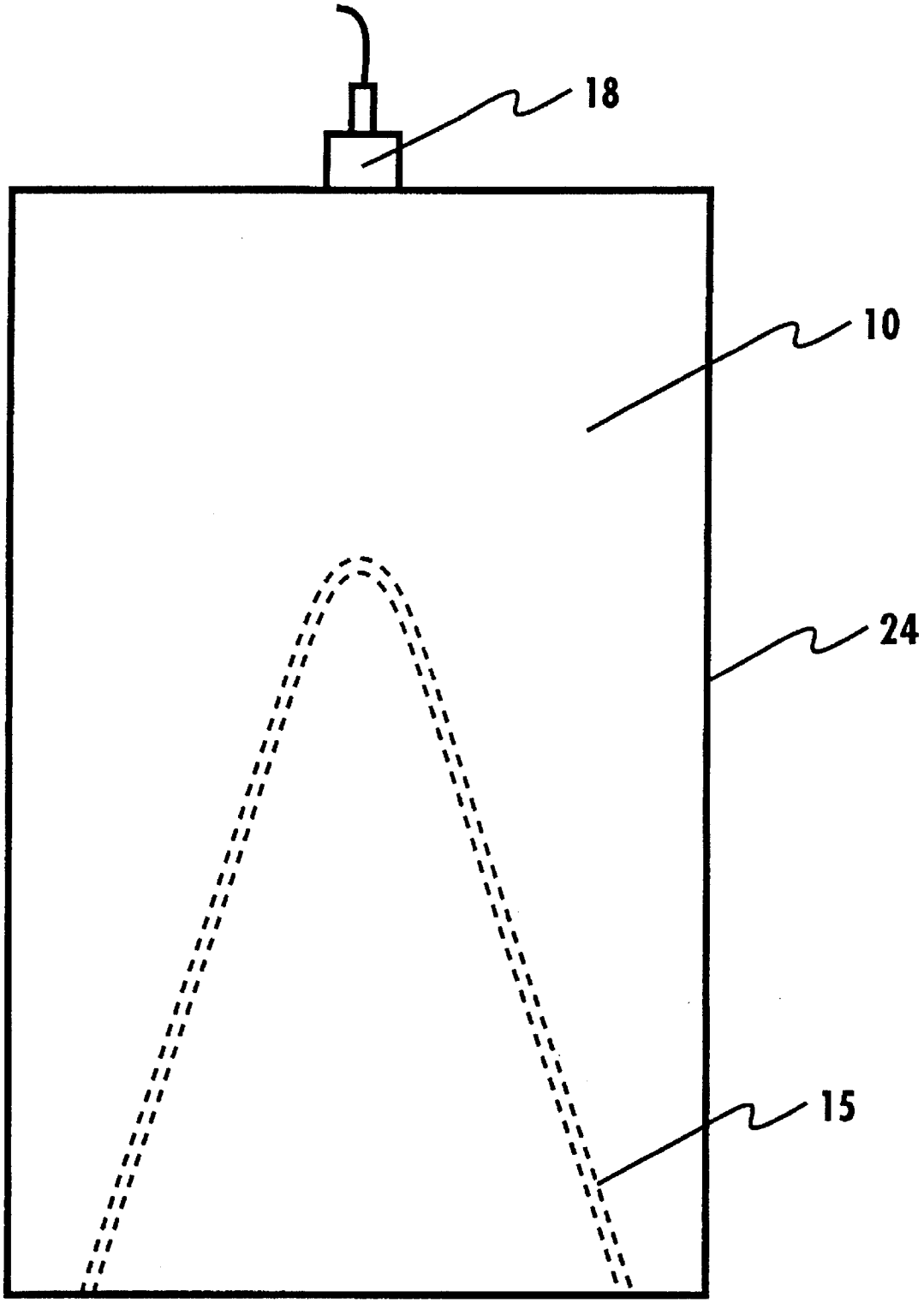
FIG. 3 is a side view of a shaped charge illustrating an alternative embodiment of the present invention.

Dispersion may be increased significantly by decreasing the subcalibration ratio, the ratio of the liner diameter to the charge diameter, as illustrated in FIG. 3. For a given fixed diameter of charge liner 15, increasing the diameter of charge 10 may create greater dispersion. The addition of additional charge material at the distal end of the charge serves to further disrupt or disperse the resulting jet.

In addition to fluted liners, other types of spin compensated liners may also be used in the present invention, for example, metallurgically compensated charge liners. A metallurgically compensated charge liner may be produced to include anisotropies within the liner. In other words, the liner may include portions having various shear strengths, hardnesses, or other varying metallurgical properties, such that liner 15 will disintegrate in a non-uniform pattern, compensating for spin characteristics imparted on a round.

Such metallurgically compensated liners are known in the art and may be formed, for example, by shear forming. In shear forming, a spinning copper blank may be formed by a mandrel pressed into the blank. Localized work hardening and annealing processes may produce anisotropies in the resulting liner in a shear pattern which may compensate for dispersing action of spin stabilization.

In addition, other types of fluted liners may be used which are not optimized to compensate for the shaped change spin rate. For example, a fluted liner having bi-directional fluting, i.e. flutes the reverse direction, may provide sufficient disturbance of the localized charge mass ration so as to result in disturbance of the resulting jet.

Thus, a fluted (or other spin compensated) charge liner may be utilized to form a dispersed jet pattern from a shaped charge round. The advantages of such a technique are numerous. For example, an identical round may be manufactured for both dispersed and coherent jet applications. Whether a dispersed or coherent jet is desired may be determined by selectively altering the spin characteristics of the round in flight (e.g., reducing or increasing spin beyond the parameters which may be compensated for by fluted liner 15, or by spinning in an opposite direction). By providing one round design for both applications, production costs may be reduced due to economies of scale. Moreover, storage and inventory costs may be reduced. In addition, the same round may be utilized in battle to target different types of targets requiring coherent or dispersed jets.

Moreover, it is within the spirit and scope of the present invention to provide a delivery mechanism (e.g., missile) which may alter spin characteristics of the round prior to detonation to produce desired jet characteristics. For example, smart targeting systems may determine, prior to firing or impact, the nature of the target and then alter the spin characteristics of the round accordingly (e.g., altering spin stabilization rate of the missile or the like, neutralizing spin, or changing spin direction) to produce desired coherent or dispersed jet patterns.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

While the preferred embodiment and various alternative embodiments of the invention have been disclosed and described in detail herein, it may be apparent to those skilled in the art that various changes in form and detail may be made therein without departing from the spirit and scope thereof.

What is claimed is:

1. A method for disrupting or dispersing a jet from a shaped charge round having a shaped charge liner that has a substantially conical shape so as to increase damage area to a target, comprising the steps of:

providing a cylindrical outer casing, said outer casing being open at one end thereof;

providing an explosive charge within said outer casing;

providing a spin compensated substantially conical shaped charge liner within said outer casing and in contact with said explosive charge, wherein the inside diameter at the open end of said outer casing is greater than the base diameter of the shaped charge liner such that a portion of said explosive charge is interposed between the base of said shaped charge liner and the inside diameter of the outer casing for providing a coherent jet upon detonation of the shaped charge round at a first predetermined spin rate and direction, and firing the shaped charge round at a second predetermined spin rate greater than zero and different from the first predetermined spin rate to provide a dispersed jet of a predetermined pattern upon detonation of the shaped charge round.

2. The method of claim 1, wherein the spin compensated shaped charge liner comprises a fluted shaped charge liner.

3. The method of claim 1, wherein the spin compensated shaped charge liner comprises a metallurgically spin compensated shaped charge liner.

4. The method of claim 1, wherein said step of firing the shaped charge round comprising the step of firing the shaped charge round at a spin rate greater than the first predetermined spin rate.

5. The method of claim 1, wherein said step of firing the shaped charge round comprising the step of firing the shaped charge round at a spin rate less than the first predetermined spin rate.

6. The method of claim 1, wherein said step of firing the shaped charge round comprising the step of firing the shaped charge round in a spin direction opposite than the first predetermined spin direction.

* * * * *